US005141045A

United States Patent [19]

Williams

[11] Patent Number: 5,141,045

[45] Date of Patent: Aug. 25, 1992

[54] DRAPERY BRACKET ASSEMBLY AND METHOD OF FORMING WINDOW TREATMENT

[76] Inventor: Johnie E. Williams, P.O. Box 808, Fayetteville, Ga. 30214

[21] Appl. No.: 680,830

[22] Filed: Apr. 5, 1991

[51] Int. Cl.[5] ..... A47H 13/14

[52] U.S. Cl. ..... 160/348; 160/349.1

[58] Field of Search ..... 160/349.1, 349.2, 348, 160/405; D8/354, 368, 370, 371; D6/578; 248/285

[56] References Cited

U.S. PATENT DOCUMENTS

| | | | |
|---|---|---|---|
| D. 260,364 | 8/1981 | Kleiman . | |
| D. 286,261 | 10/1986 | Smederod . | |
| D. 292,370 | 10/1987 | Fairbanks . | |
| 1,352,656 | 9/1920 | Cahill . | |
| 2,092,156 | 9/1937 | Harper | 160/349.1 X |
| 2,329,446 | 9/1943 | Whitehead | 160/349.2 |
| 2,337,950 | 12/1943 | Werner | 160/349.2 X |
| 2,390,116 | 12/1945 | Michelman | 160/133 |
| 2,431,934 | 12/1947 | Higgins | 160/349.2 |
| 3,203,469 | 4/1963 | Falkenberg . | |
| 3,417,807 | 3/1966 | Falkenberg . | |
| 3,545,523 | 12/1970 | Falkenberg . | |
| 3,654,983 | 4/1972 | Hachtew | 160/348 |
| 3,901,303 | 8/1975 | Falkenberg . | |
| 3,970,134 | 7/1976 | Sinnock et al. | 160/133 |
| 4,284,258 | 8/1981 | Kleiman . | |
| 4,958,646 | 9/1990 | Hannerstig . | |
| 5,012,851 | 5/1991 | Hannerstig . | |
| 5,018,567 | 5/1991 | Hannerstig . | |
| 5,078,199 | 1/1992 | Hannerstig | 160/348 |

OTHER PUBLICATIONS

*The Triple Crown Bracket TM*, four-page brochure.

*Primary Examiner*—J. Franklin Foss

*Attorney, Agent, or Firm*—Hoffman, Wason & Gitler

[57] ABSTRACT

A drapery bracket assembly including a drapery bracket with a rearwardly projecting tongue, and an L-shaped mounting bracket that is secured to a supporting wall. An elongated slot is formed in the mounting bracket so that the drapery bracket can be adjusted relative thereto. The drapery bracket includes a horizontally extending bar with several pairs of fingers extending vertically therefrom; an arcuate loop is formed atop each pair of fingers.

A method fan-folding drapery material, and then manipulating same into locking engagement with the drapery bracket is set forth. The resultant ornamental configuration of the drapery material may be a rosette, a bow, or a combination thereof.

6 Claims, 4 Drawing Sheets

DRAPERY BRACKET ASSEMBLY AND METHOD OF FORMING WINDOW TREATMENT

BACKGROUND OF THE INVENTION

The present invention relates generally to hardware for hanging drapes, and more particularly to unique brackets assemblies, and methods of utilizing same, to hang drapes about window frames, door openings, and the like.

One, very common, window treatment involves (1) a curtain that is hung on one, or more traverse rods secured about the window, and (2) a drapery that is hung in front of the curtain. The curtain may be of a sheer material that hangs downwardly, in front of the window. The drapery, which extends further into the interior of the room, covers the traverse rod and related hardware to enhance the visual appeal of the window treatment. While the drapery may assume different shapes and configurations, one configuration that has gained widespread acceptance is the swag, or festoon, drape.

A swag drape requires, as a minimum, a pair of brackets, one bracket situated at, or in proximity to, an upper corner of the window frame. Each bracket is secured to the window frame, or to the wall adjacent to the window frame, and each bracket must extend away from the wall a distance sufficient to clear the traverse rods employed to support the curtain. Clips, springs, or other securing devices are used in conjunction with conventional brackets to retain the drapery material in fixed relationship to the brackets, once the drapery material has been passed thereover.

Diverse brackets have been developed to address the problems encountered in hanging drapes. To illustrate, U.S. Pat. No. 2,431,934, granted Dec. 2, 1947, to Harry F. Higgins, discloses a ring bracket 10 for supporting, and securing, a drapery in a predetermined position. The drapery, as shown in FIG. 2 of Higgins, comprises a pleated, vertically extending panel along each side of the window joined by a downwardly bowed section, also known as a festoon or swag.

Each ring bracket 10 is formed of metal rod, and comprises parallel arms 13, 14, which terminate, at their forward ends in a split ring 12. A rectangular bracket 15 is secured to the rear ends of arms 13, 14. When the bracket is secured to a window frame or wall, the split ring 12 extends forwardly into the room or enclosure. About one-half of the drapery material is then trained through the interstice 14 defined between parallel arms 12, 13 in each bracket, while the remainder of the drapery material falls through split ring 12 to form the swag or festoon, as shown in FIG. 3 of Higgins. The swag is thus held between the rings, while the vertical panels may be adjusted.

Another drapery bracket, and one that has realized commercial success, is shown in U.S. Pat. No. 4,284,258, granted Aug. 18, 1981, to Stanley Kleiman. Such patent discloses a festoon support device 10 including a pair of mounting brackets 11 and a forwardly projecting festoon support arm 24 separably coupled to each of the brackets, as shown in FIG. 2. A depending loop 30 is integrally formed at the rear portion of each arm to allow the arm to securely rest on a curtain rod without tripping. A spring 36 is located on the top face of the arm to cooperate with serrated strips 37 to engage, and retain, a festoon. An angularly adjustable ornament 13 is separably mounted, by head 39 and coupling 40, to the front of each arm.

Yet other drapery brackets are disclosed in U.S. Pat. No. 4,958,646, granted Sep. 25, 1990, to Christer Hammerstig. In the embodiment of FIGS. 1–4, each bracket 10 is a metal bar that is formed into an unusual shape. As shown in the side elevational view of FIG. 1 of Hammerstig, one end of the bracket is secured to support wall 14 by screws 15, while the other end of the bracket is fashioned as a terminal portion 16. A rearwardly opening body is defined by parallel legs 11, 12. A rosette 18 is secured to the front of the body by fastener 19. The drapery material 13 is threaded between legs 11, 12 and draped over the top of leg 11 in sufficient thickness that terminal portion 16 presses thereagainst and retains the drapery material in fixed position. One bracket 10 is used at each upper corner of the window frame, while a somewhat different intermediate bracket 22 is located in the middle of the frame window. The resultant drapery is shown in FIG. 3.

An alternative embodiment of a drapery bracket is shown in FIGS. 5–10 of Hammerstig. While the bracket 10 shown in FIGS. 1–4 employs terminal portion 16 to secure the threaded drapery material in position, the embodiment of FIGS. 5-10 relies upon the formation of a fabric rosette, and the inherent resiliency of the metal drapery bracket, to achieve such desirable result. The bracket 100 is formed of a flat metal bar that is bent to form a substantially C-shaped body 106. The body is defined by parallel arms 101, 102, and the body is joined to an L-shaped bracket 105. The rearward end of the bracket 105 is secured to a supporting wall by mounting plate 108 and screws 109, as shown in FIG. 5.

In use, drapery material 13 is pleated, and is then placed over bracket 105, as shown in FIG. 6. The user then forces the upper ends of resilient arms 101, 102 apart, so that an upper layer of drapery material 110 can be pulled forwardly therethrough, as shown in FIG. 7. Subsequently, the prongs return to their unstressed position, and the drapery material is turned back over the prongs 101, 102 to form a fabric rosette 107, as shown in FIG. 9. The fabric rosette tends to lock the drapery material in fixed position, and the resultant drapery is shown in FIG. 10.

While the above described drapery brackets performed satisfactorily in most instances, considerable skill was required of the craftsman performing the installation. Also, great care had to be taken by the user, particularly when the portion of the drapery material hanging downwardly between the horizontally spaced drapery brackets, was pulled downwardly to form the arcuate folds, known as a festoon, or a swag. The downward tugging on the drapery material tended to unduly loosen the clamping action of the spaced brackets upon the drapery material, and the arcuate folds tended to sag, thus diminishing the esthetic appeal of the window treatment.

Furthermore, the weight of the unsupported drapery material tended to pull the drapery free from the drapery brackets. With the passage of time, the brackets tended to deform, and the efficiency of the clamping action diminished. The use of heavy and/or bulky drapery materials, and the increase in the width of the window opening being draped, contributed to the loss of efficiency. Simpler, intermediate brackets, configured somewhat differently than the horizontally spaced drapery brackets located at the upper ends of a window frame, were employed to offset the reduction in clamping action; such approach is suggested by the intermediate bracket shown in FIGS. 3 and 4 of Hammerstig.

Although the demand for easy to install, and simple-to-use, drapery brackets continued to mount, none of the presently available brackets satisfied such demand. Consumers further sought a bracket would enable them to readily pleat the drapery material associated with such bracket, and to easily lock the pleated material to a pair of horizontally spaced brackets. The homeowner could then install the necessary hardware and inexpensively form his, or her, own window treatment that would approximate the efforts usually achieved by a professional interior decorator or skilled craftsman.

SUMMARY OF THE INVENTION

The present invention realizes the objective of an easily installed drapery bracket assembly that is so configured that a fabric rosette or bow can be locked thereto. Such ability enables the consumer, with even minimal skill, to thread pleated drapery material through the bracket, and then manipulate the fabric to lock same in fixed position, without resorting to separate fasteners, clamping mechanisms, etc. A festoon or swag can be formed between a pair of brackets situated at the opposite upper ends of a window, with relative ease and in an esthetically pleasing manner.

The bracket constructed in accordance with the present invention can assume many forms. However, each bracket is formed of metal rod, and comprises a base, four or more pair of posts welded to the base and extending vertically upwardly therefrom, a loop joining the upper ends of each pair of posts, a tongue projecting rearwardly from the base and perpendicular to the posts, an elongated slot formed in the tongue, an L-shaped mounting bracket, and fasteners for securing the tongue to the bracket, and the bracket, in turn, to the window frame or the support wall. The base may be a rod extending parallel to the supporting wall, or may be D-shaped, with the vertical extent of the base parallel to the supporting wall.

The L-shaped mounting bracket comprises two legs disposed perpendicularly to each other. One leg depends downwardly, and is positioned against the window frame, or supporting wall. The bracket will be secured by screws or nails passing through apertures in the depending leg. The second leg projects forwardly from the window frame or supporting wall, and an elongated slot is defined in the second leg. The elongated slot in the second leg is aligned with the slot in the tongue of the bracket, and bolts or screws are passed through the aligned slots. Nuts are threaded onto the depending ends of the threaded fasteners. The bracket can be shifted closer to, or farther away from, the window frame or supporting wall to accommodate traverse rods, of different sizes, used to suspend curtains in front of the window. Such adjustability multiplies the potential applications for the present invention in conjunction with existing, previously installed hardware for curtains.

The present bracket facilitates the threading of fan-folded fabric through the pairs of posts from the front of the fixture, a position of increased visibility, where one person can work unaided. After the fabric is properly threaded, then the user can fold a portion of the fabric back over the loops and lock the fabric thereto, in a rosette or bow. The rosette, or bow, is retained on the loops and arcuate, depending folds can readily be formed into a festoon or swag. Because of the increased visibility available to the user from the front of the bracket, and because the folded fabric is retained securely in position by the locking action of the rosette, or bow, even unskilled amateurs can install window treatments with a minimum of time and effort.

The bracket assembly, including fasteners, can be reduced to several small components that can be packaged in a pouch, or blister-pack, and sold, in large quantities and at relatively low prices, in hardware stores and other mass-marketing outlets, to the general public.

Yet other advantages of the present invention will become readily apparent to the reader from the ensuing specification when construed in harmony with the appended drawings.

DESCRIPTION OF PREFERRED EMBODIMENT

Figure 1:
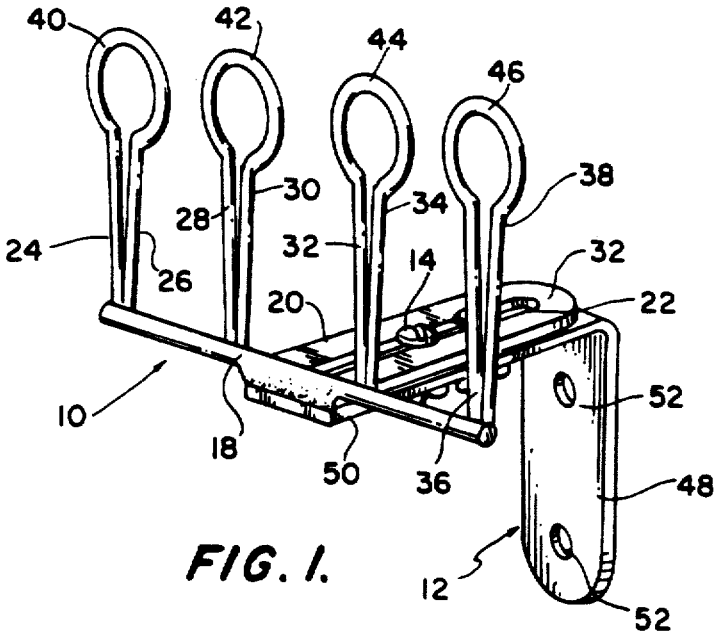
FIG. 1 is a perspective view of a preferred embodiment of a drapery bracket assembly constructed in accordance with the principles of the present invention.

Referring now to the drawings, FIGS. 1–6 depict the preferred embodiment of applicant's unique drapery bracket assembly. More specifically, the drapery bracket assembly comprises a drapery bracket 10, a mounting bracket 12, and mechanical fasteners, such as bolt 14 and wing-nuts 16 for joining the components 10, 12 together.

Figure 2:
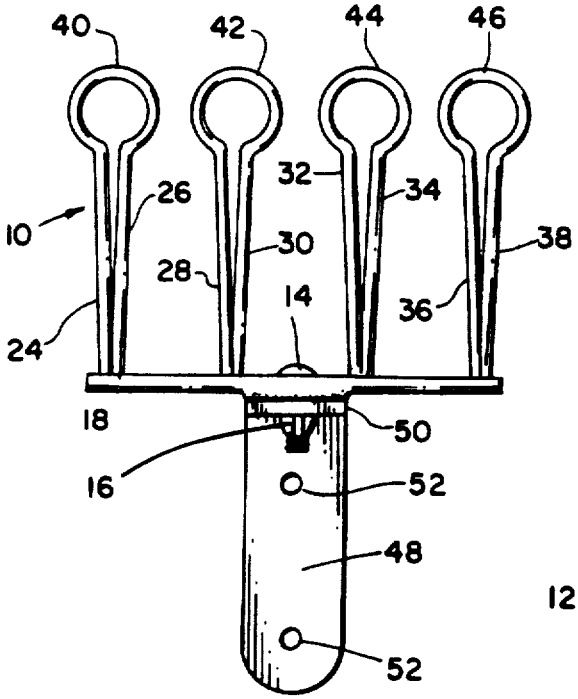
FIG. 2 is a front elevational view of the drapery bracket assembly of FIG. 1.

Drapery bracket 10 is formed of several metallic, rod-like sections, welded or soldered together into a unitary structure. Drapery bracket 10 includes a horizontally extending bar 18 and a rearwardly projecting tongue 20. An elongated slot 22 is formed in tongue 20. Four pairs of spaced fingers 24, 26; 28, 30; 32,34; and 36,38 are joined to bar 18 and project vertically therefrom. Each pair of fingers diverges slightly, as shown in FIG. 2. An arcuate loop 40 extends between fingers 24, 26, while an arcuate loop 42 extends between fingers 28, 30. A third arcuate loop 44 extends between fingers 32, 34, while a fourth arcuate loop 6 extends between fingers 36, 38. The fingers are rigid and maintain their relative spacing.

Figure 3:
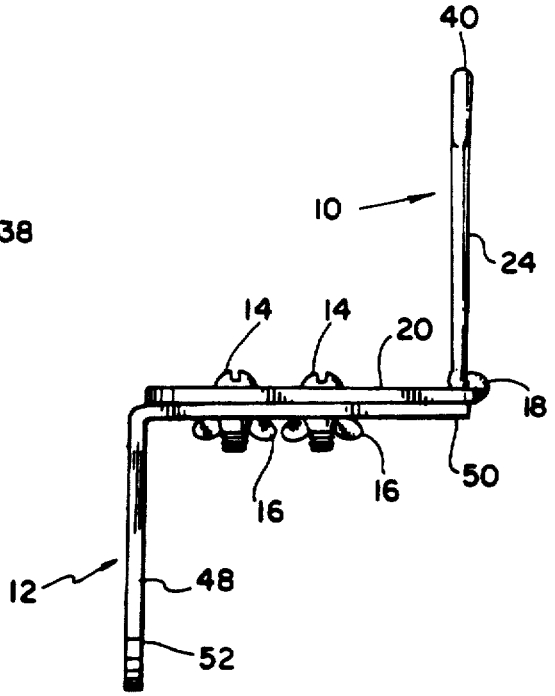
FIG. 3 is a side elevational view of the drapery bracket assembly of FIG. 1.

Mounting bracket 12 includes a depending leg 48 and a forwardly projecting leg 50; the legs 48, 50 are disposed perpendicular to one another, as shown in FIG. 3. Apertures 52 are formed through leg 50, and such apertures are aligned with slot 22 in tongue 20 of drapery bracket 10. The bolts 14 are passed through the aligned apertures and slot 22. Subsequently, after the depending leg is joined to the supporting surface, such as a wall or window frame, as by passing nails or other fasteners through the apertures in leg 48, the drapery bracket 10 is adjusted relative to fixed mounting bracket 12. The adjustment spaces the front of bracket 10 a desired distance from the supporting surface. The ability to alter the spacing of bracket 10 relative to the supporting surface permits the installer to utilize applicant's bracket assembly with existing traverse rods, drapery rods, shades, blinds, etc.

Figure 4:
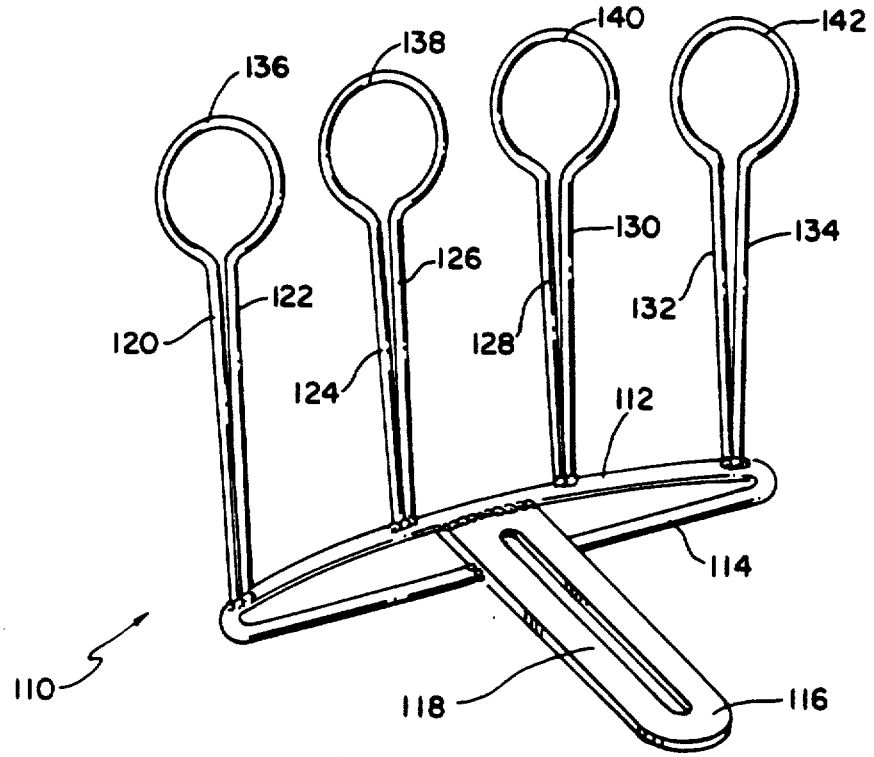
FIG. 4 is a rear perspective view of an alternative embodiment of a drapery bracket constructed in accordance with the principles of the present invention.
Figure 5:
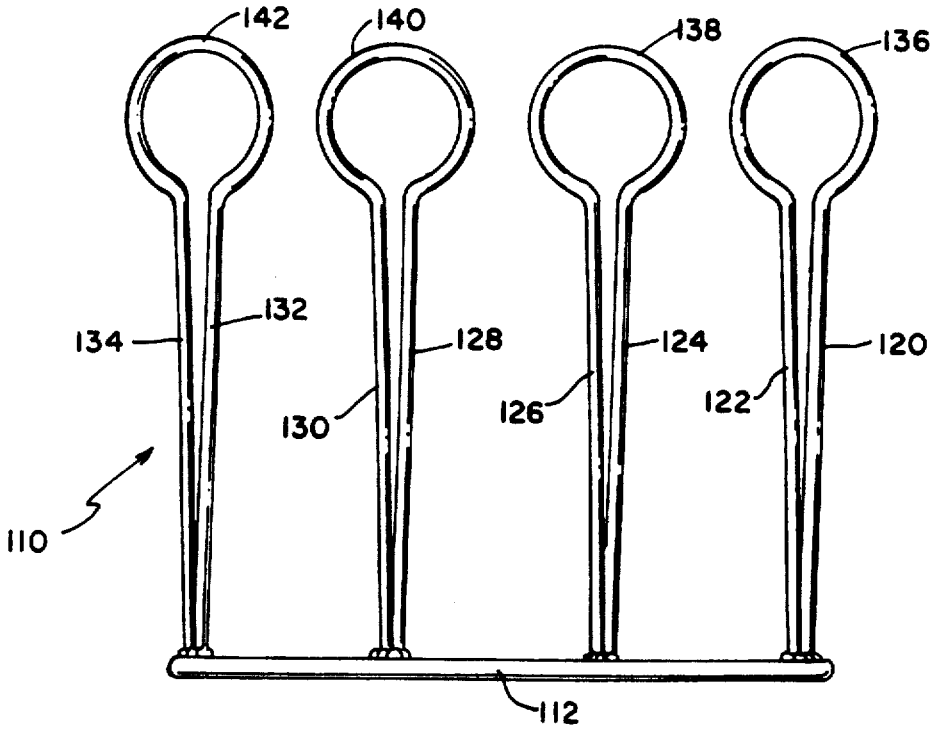
FIG. 5 is a front elevational view of the drapery bracket of FIG. 4.

An alternative embodiment of drapery bracket 110 is shown in FIGS. 4 and 5; the mounting bracket 12 remains unchanged from FIGS. 1-3 and thus has not been shown in FIGS. 4-5. Drapery bracket 110 includes a bowed front bar 112 and a horizontally extending rear bar 114; the bars define a D-shaped base. A rearwardly projecting tongue 116 extends from the rear surface of bar 112 toward a mounting bracket (not shown). An elongated slot 118 is defined in tongue 116, so that the drapery bracket can be adjustably mounted with respect to a supporting surface. Four pairs of spaced fingers 120, 122; 124, 126; 128, 130; 132, 134 are joined to bar 112 and project vertically therefrom. Each pair of fingers diverges slightly, as shown in FIG. 5. An arcuate loop 136 extends between fingers 120, 122, while an arcuate loop 138 extends between fingers 124, 126. A third arcuate loop 140 extends between fingers 128, 130, while a fourth arcuate loop 142 extends between fingers 132, 134. The fingers are rigid and maintain their relative spacing.

Figure 6:
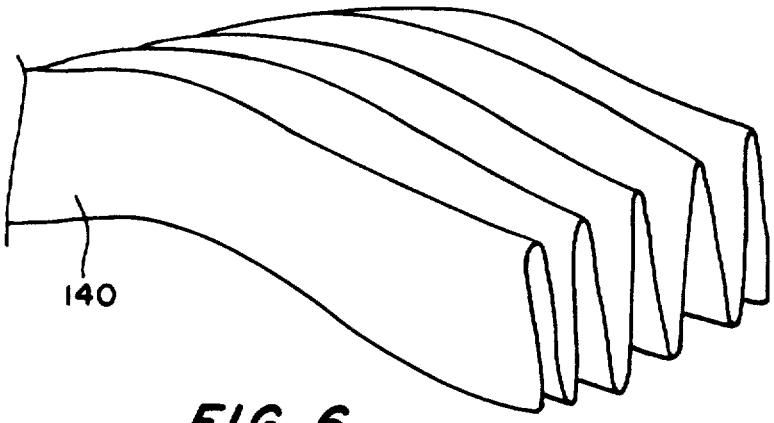
FIGS. 6–8 show, sequentially, the method of securing drapery fabric to the present drapery assembly.
Figure 7:
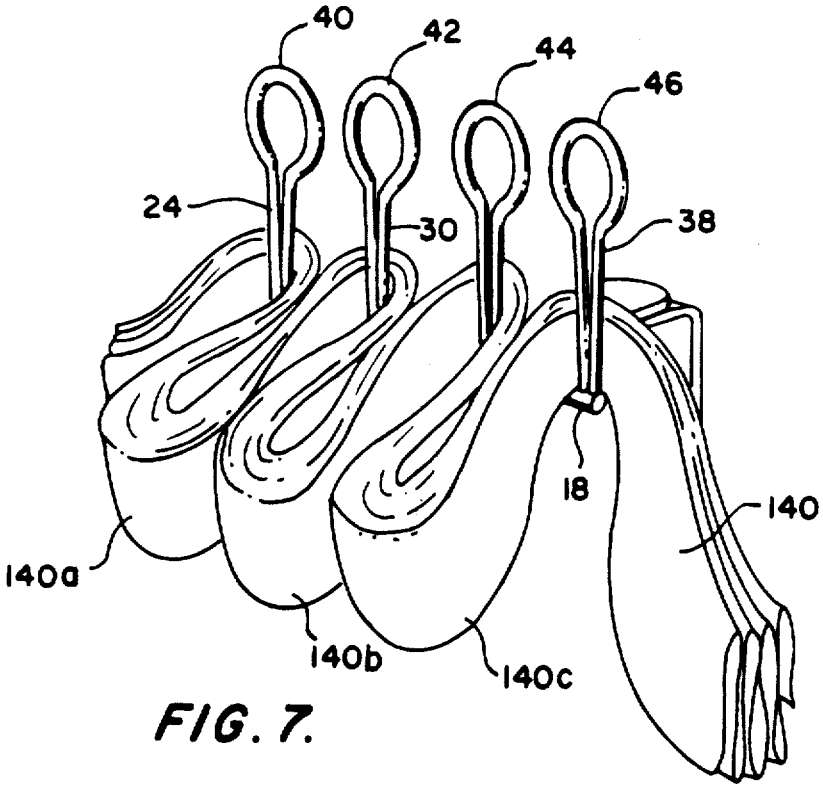
Figure 8:
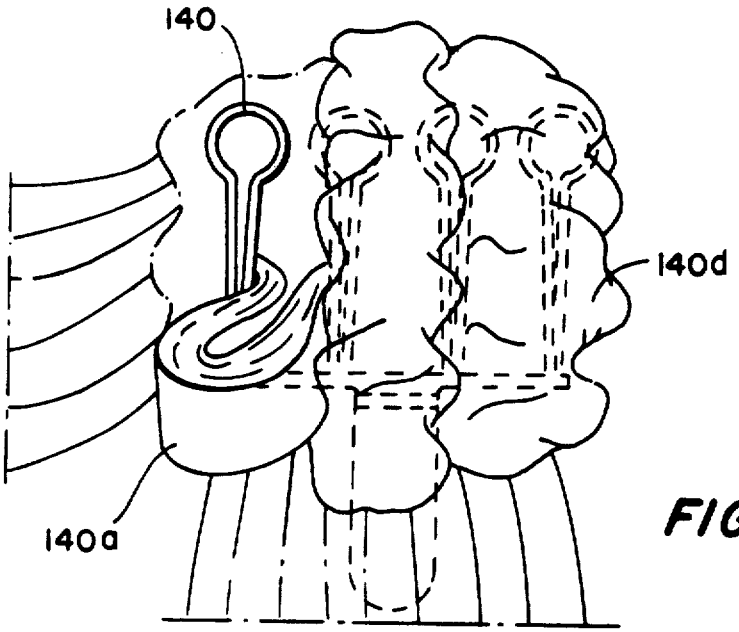
Figure 9:
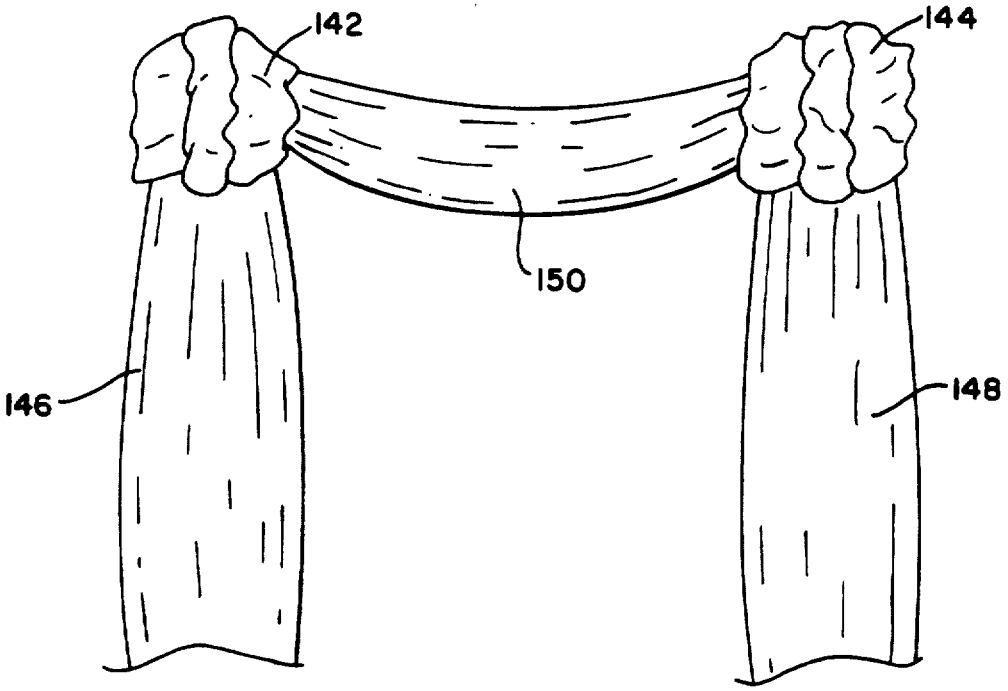
FIG. 9 shows the completed window treatment formed by the method shown in FIGS. 6–8; and utilizing the drapery bracket assembly of FIGS. 1–3, or the alternative embodiment of FIGS. 4–5.

The manner in which the two embodiments of the drapery bracket are utilized is depicted in FIGS. 6-8, and the completed window treatment is shown in FIG. 9. FIG. 6 shows that the drapery material 140 to be suspended from a drapery bracket (such as bracket 10 or bracket 110) is fan-folded, thus forming several folds of material. The folds may be approximately three inches in depth.

Then from an advantageous position in front of the drapery bracket, the user drops a loop of fabric into each slot defined between adjacent pairs of upstanding fingers. The loops are identified by reference numerals 140*a*, 140*b* and 140*c*.

Next, as shown in FIG. 8, the user spreads the entire width of the fan-folded drapery material. Such step is achieved by using one hand to hold loop 140*c*, while pulling fabric out into small wrinkles 140*d* with the other hand. By judicious spreading of the fabric over the arcuate loops, one loop at a time, ornamental bows 142 and 144 may be formed. Such bows may assume the form of a rosette, bow, double loop rosette, bow and flower, tri-color rosette (requires three coordinating fabrics), or combinations and variations of the above-mentioned ornamental bows.

As shown in FIG. 9, bows 142 and 144, which are located in the opposite, upper corners of a window or wall opening, serve to lock the window treatment to a pair of drapery brackets. The resultant window treatment includes a first vertical panel 146, a second vertical panel 148, with a swag 150 extending therebetween.

Additional details of drapery bracket 10 will be found in applicant's co-pending design patent application 07/510,996, filed Apr. 19, 1990. Additional details of drapery bracket 110 will be found in applicant's co-pending design patent application Ser. No. 07/656,057, filed Jan. 25, 1991.

Manifestly, variations and modifications in the configuration of drapery brackets 10 and 110 will occur to the skilled artisan. While four pairs of fingers have produced superior results in actual installations, the base of the bracket might be extending horizontally, and additional pairs of fingers could be utilized. In place of a pair of spaced drapery brackets, one in each upper corner of a window frame or associated support wall, one larger drapery bracket might be used to traverse the entire width of the window opening. Somewhat different methods of installing the drapery material, and locking same to the drapery brackets, might also be employed with equal success. Consequently, the appended claims should not be limited to their literal terms, but should be broadly construed in a fashion consistent with the present advances in the useful arts and sciences.

I claim:

1. A drapery bracket assembly adapted to retain drapery material in fixed position, a) a drapery bracket, b) said drapery bracket including a base comprising a horizontally extending bar at the front of the bracket and a rearwardly projecting tongue, c) said tongue having an elongated slot defined therein, d) a plurality of pairs of fingers secured to said horizontal bar to project vertically therefrom, e) a plurality of arcuate loops, one loop for each pair of fingers, said loops between formed at the upper end of each pair of fingers and extending therebetween, f) a mounting bracket comprising a depending leg adapted to be secured to a support surface and a forwardly projecting leg disposed perpendicular to said depending leg, g) said forwardly projecting leg having apertures formed therein, h) said apertures in said forwardly projecting leg being aligned with said slot in said rearwardly projecting tongue, i) mechanical fasteners being passed through said apertures and said slot so that said drapery bracket can be adjusted in a horizontal plane relative to said mounting bracket.

2. The drapery bracket assembly as defined in claim 1 wherein each of said pairs of fingers diverge slightly, and wherein said pairs of fingers are rigid.

3. The drapery bracket assembly as defined in claim 1 wherein said plurality of pairs of fingers comprise at least three pairs in the same vertical plane.

4. The drapery bracket assembly as defined in claim 1 wherein said base further includes a horizontally extending rear bar, and bar at the front of the bracket is arcuate in shape, said bars being formed in a D-shape when viewed from above.

5. A method of securing drapery material to a drapery bracket, said bracket including a base comprising a horizontally extending bar at the front of the bracket and a rearwardly projecting tongue, a mounting bracket, a plurality of pairs of fingers secured to said bar and projecting upwardly therefrom, a plurality of arcuate loops extending between the upper ends of adjacent pairs of fingers, mechanical fasteners for securing the drapery bracket to the mounting bracket, and, the mounting bracket to a support wall, said method comprising the steps of:

a) fan-folding the drapery material into a series of folds, b) passing the fan-folded material, in a horizontal plane, above the bar and between adjacent pairs of fingers to define a series of loops projecting forwardly of the horizontal bar, c) spreading the drapery material vertically upwardly and over the arcuate loop for each pair of fingers to lock the material in place on the drapery bracket.

6. The method of claim 5 wherein the drapery material is spread, sequentially, over the arcuate loop for each pair of fingers, so that the drapery material is formed into an ornamental shape that locks the drapery material to the drapery bracket.

* * * * *